United States Patent [19]

Campbell

[11] Patent Number: 4,612,958

[45] Date of Patent: Sep. 23, 1986

[54] BOILER SAFETY VALVE INSTALLATIONS

[75] Inventor: John W. E. Campbell, Maidenhead, England

[73] Assignee: Babcock Power Limited, London, England

[21] Appl. No.: 581,064

[22] Filed: Feb. 17, 1984

[30] Foreign Application Priority Data

Feb. 22, 1983 [GB] United Kingdom ..... 8304886

[51] Int. Cl.[4] ..... F16K 47/00

[52] U.S. Cl. ..... 137/801; 126/389; 137/39

[58] Field of Search ..... 126/389; 137/801, 888; 138/39; 417/178, 196, 198

[56] References Cited

U.S. PATENT DOCUMENTS 4,166,477 9/1979 Duthion et al. ..... 137/801 X

FOREIGN PATENT DOCUMENTS 717409 2/1980 U.S.S.R. ..... 417/198

*Primary Examiner*—Gerald A. Michalsky

*Attorney, Agent, or Firm*—Solon B. Kemon

[57] ABSTRACT

A boiler safety valve installation with a safety valve discharging relief steam through an upstand into a separately supported vent pipe. The upstand discharges through a belled nozzle approximately 30° (0.5 steradian) included angle into the vent pipe thereby, on discharge of relief steam, inducing a sub-atmospheric pressure in the space intermediate the discharge nozzle and the vent pipe and lessening the risk of escape of steam at a sliding junction between the upstand and the vent pipe. In installation where the relief steam flow reaches supersonic velocity at discharge from the belled nozzle the vent pipe diameter is constricted by about 5%–10% at a zone downstream of the discharge nozzle to produce a shock front and reduce the velocity to sub-sonic, thereby reducing the frictional flow loss effects while economizing in vent pipe size without causing a build-up of back pressure in the space intermediate the discharge nozzle and the vent pipe.

1 Claim, 2 Drawing Figures

BOILER SAFETY VALVE INSTALLATIONS

DESCRIPTION

This invention relates to boiler safety valve installations.

A power station boiler usually has a number of safety valves for relieving the steam pressure when necessary from the boiler drum and from steam pipes. A safety valve is usually mounted on or close to the boiler component to be protected but the release of the relief steam into the atmosphere should be allowed only where it cannot cause damage or injury to personnel, for example, well above the boiler roof. A common safety valve installation therefore includes a vent pipe arranged to receive the relief steam discharged from the safety valve outlet pipe and to convey it to a safe final release point; at such point the vent pipe may terminate in a silencer. The discharge mouth of the safety valve outlet pipe is most simply positioned co-axially with the vent pipe to discharge an expanding jet of relief steam in the direction along the vent pipe towards the final release point.

Whereas the safety valve moves under boiler expansions and contractions with the component to be protected, the vent pipe will generally be supported by the boiler structural framework, and then allowance must be made for relative movement between the safety valve outlet pipe and the receiving end of the vent pipe. Sliding means provide a partial seal between the surrounding atmosphere and the space at the receiving end of the vent pipe upstream of the expanding relief steam jet but nevertheless the pressure within such space should if possible be less than surrounding atmospheric when relief steam is being discharged and normally such will be the case.

In a boiler safety valve installation including a vent pipe arranged to receive relief steam discharges from the safety valve outlet pipe, the discharge mouth of the said outlet pipe being positioned co-axially with the vent pipe to direct the expanding jet of relief steam along the vent pipe, according to the present invention the said discharge mouth is formed as or provided with an expanding nozzle adapted to accelerate the expanding relief steam jet.

Figure 1:
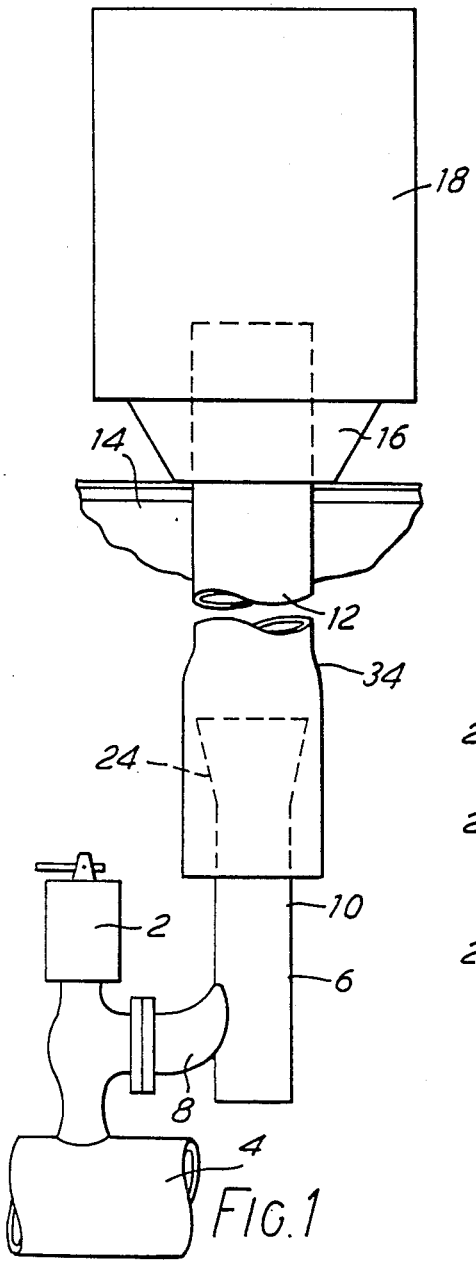
Figure 2:
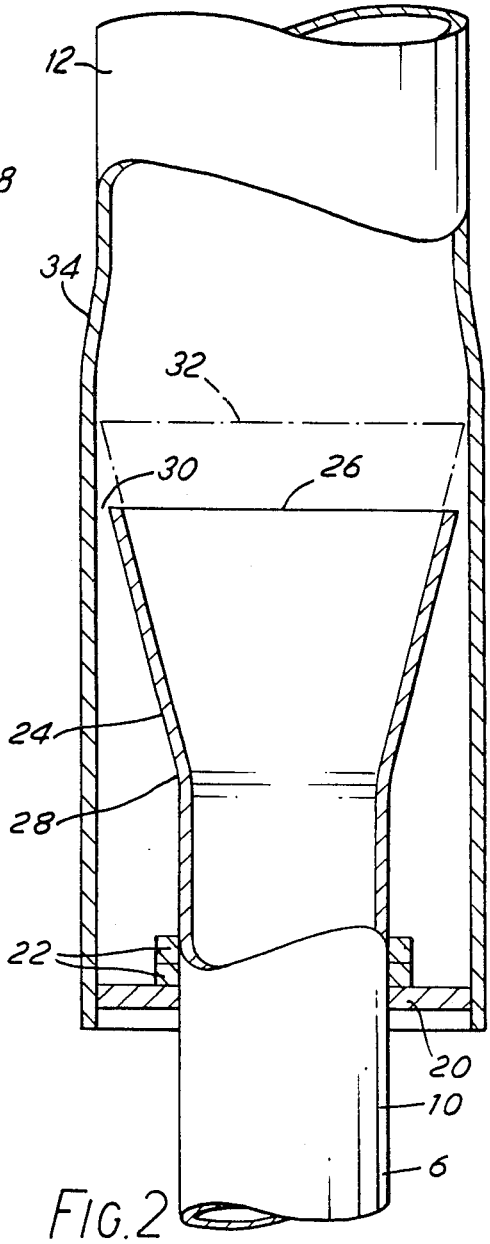

The invention will now be described, by way of example, with reference to the accompanying, partly diagrammatic drawings, in which:

FIG. 1 is an outline elevation of a boiler safety valve, an outlet pipe and an associated vent pipe installation; and FIG. 2 is cross-sectional elevation of overlapping portions of the outlet pipe and the vent pipe, to an enlarged scale.

As shown in FIG. 1, a safety valve 2 is positioned on a boiler steam pipe 4 and has an outlet pipe 6, consisting of an elbow 8 and an upstand 10, connected thereto. The outlet pipe 6 discharges into a vent pipe 12 extending to an upper level of the boiler steelwork 14. The vent pipe 12 is provided with mounting means 16 connected to the steelwork and discharges into a silencer 18.

Referring to FIG. 2, the vent pipe 12 has an internal diameter approximately twice the internal diameter of the outlet pipe 6 and is provided with an inwardly directed collar 20 making a loose fit around the outlet pipe. Sealing rings 22 are provided at least partially to seal the outlet pipe 6 to the collar 20. A discharge nozzle portion 24 of the outlet pipe is belled outwardly to a lip 26 with an included angle of approximately 30° (0.5 steradian). A smooth curved surface is imposed at the transition 28 between the discharge nozzle portion 24 and the upstand 10. An annular gap 30 is provided between the lip 26 and the wall of the vent pipe 12 to accommodate minor mis-alignment on assembly and differential thermal expansion when in operation.

At a level slightly above a level 32 at which an imaginary continuation of the inner surface of the discharge nozzle portion 24 intersects the wall of the vent pipe 12, the vent pipe is smoothly swaged in at a zone 34 to give a diameter reduction of between 5% and 10%.

In operation, should the safety valve 2 lift, a flow of relief steam is discharged with a velocity which can reach Mach 1 at the transition 28 of the belled discharge nozzle portion 24. The divergent form of the belled discharge nozzle portion 24 is such that the steam flow undergoes expansion and a velocity of approximately Mach 2 can be achieved at the level of the lip 26. If the steam flow from the belled discharge nozzle portion 24 is still supersonic upon re-attachement to the wall of the vent pipe 12 at about the level 32 a shock front will be formed at the zone 34 such that a subsonic velocity results.

Compared with the previous constant diameter cylindrical form of the outlet from the upstand 10, the divergent, belled, form of the discharge nozzle 24 by producing an efficient discharge flow reduces the dissipation of some of the expanding jet forward momentum into eddies and into excessive transverse momenta.

A result of discharging the relief steam into the vent pipe 12 through such a belled discharge nozzle portion 24 is that there prevails within the receiving end of the vent pipe upstream of the relief steam jet a lower back pressure in the vent pipe base than would prevail if the outlet pipe terminated in a plain mouth. Thus any risk of premature steam escape into the atmosphere past sealing means such as the collar 20 and the sealing rings 22 that may have become defective is less.

It will be appreciated that the angle of divergence of the discharge nozzle portion 24 is not critical and may lie in the range of between approximately 12° (0.2 steradian) and 60° (1 steradian) as derived from known calculations concerned with steam flows from throats in general where choked conditions prevail.

In addition, for supersonic flows, by providing the slight decrease in the vent pipe diameter at the zone 34—and downstream thereof—to render the flow subsonic, the shock front between supersonic and subsonic flow is moved nearer to the discharge nozzle portion 24 than would otherwise be the case without adversely affecting the subatmospheric pressure, produced during discharge, at the base of the vent pipe. Since frictional losses are much greater at supersonic flows than at subsonic flows it has hitherto been the practice to provide a vent pipe of a diameter in excess of twice the diameter of the upstand 10 in order to reduce the frictional effects. However, by providing a smoothly tapering reduction in vent pipe diameter of approximately 5% to 10% the flow velocity is reduced to subsonic—so that the frictional effects are markedly reduced whilst at the same time achieving a reduction in the amount of material in, and consequently the mass of, the vent pipe. Thus, without increase in the risk of premature steam escape at the junction of the upstand and the vent pipe, the vent pipe may be designed of somewhat smaller diameter, making possible a boiler capital cost saving dependent upon the number, which may be large, of safety valve installations in the boiler and upon the lengths, considerable in some cases, of the vent pipes involved.

I claim:

1. A boiler safety valve installation including a boiler steam pipe having a safety valve with an outlet pipe positioned thereon and a vent pipe for receiving relief steam discharges from the safety valve, said outlet pipe having a discharge mouth positioned co-axially with said vent pipe to direct an expanding jet of relief steam along said vent pipe, wherein the said discharge mouth is provided with an expanding nozzle diverging outwardly from the outlet pipe as a frusto-conical nozzle having an included angle of between approximately 12° (0.2 steradian) and 60° (1 steradian), and adapted to accelerate the expanding relief steam jet, a transition from the safety valve outlet pipe to the expanding nozzle being formed as a smoothly curved surface, the expanding nozzle having a lip positioned to be closely spaced from the vent pipe, and the vent pipe being formed with a smooth constriction reducing the internal diameter of the vent pipe by between approximately 5% and 10%, displaced downstream of the discharge mouth and adapted to produce a reduction in relief steam flow velocity from supersonic to subsonic velocity.

* * * * *